US010208452B2

(12) United States Patent
Kunz

(10) Patent No.: US 10,208,452 B2
(45) Date of Patent: Feb. 19, 2019

(54) BUCKET FOR IMPLEMENT SYSTEM HAVING SYMMETRICAL TOOTH MOUNTING MEMBERS

(71) Applicant: Caterpillar Inc., Peoria, IL (US)

(72) Inventor: Phillip Kunz, Morton, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/466,402

(22) Filed: Mar. 22, 2017

(65) Prior Publication Data

US 2018/0274201 A1 Sep. 27, 2018

(51) Int. Cl.

| | |
|---|---|
| ***E02F 9/28*** | (2006.01) |
| ***E02F 3/40*** | (2006.01) |
| ***E02F 9/22*** | (2006.01) |
| *E02F 3/32* | (2006.01) |
| *E02F 3/30* | (2006.01) |

(52) U.S. Cl.

CPC ..... *E02F 3/40* (2013.01); *E02F 9/2271* (2013.01); *E02F 9/2808* (2013.01); *E02F 3/304* (2013.01); *E02F 3/308* (2013.01); *E02F 3/32* (2013.01)

(58) Field of Classification Search

CPC ..... E02F 9/2808; E02F 9/2816; E02F 9/2825; E02F 9/2858

See application file for complete search history.

(56) References Cited

U.S. PATENT DOCUMENTS

| | | | | |
|---|---|---|---|---|
| 4,932,145 | A | 6/1990 | Reeves | |
| 5,016,365 | A | 5/1991 | Robinson | |
| 7,926,207 | B2 | 4/2011 | Almendros et al. | |
| 8,943,716 | B2 | 2/2015 | Renski et al. | |
| 9,260,839 | B2 * | 2/2016 | Kunz | E02F 9/2825 |
| 9,562,340 | B2 * | 2/2017 | Yoshida | E02F 3/40 |
| 2013/0086826 | A1 * | 4/2013 | Renski | E02F 9/2808 37/452 |
| 2015/0211215 | A1 | 7/2015 | Dallard et al. | |
| 2016/0251821 | A1 * | 9/2016 | Yoshida | E02F 3/40 414/685 |
| 2017/0044743 | A1 * | 2/2017 | Balan | E02F 9/2883 |

FOREIGN PATENT DOCUMENTS

| | | | | |
|---|---|---|---|---|
| JP | 2001342649 A | 12/2011 | | |
| JP | 6231339 B2 * | 11/2017 | | E02F 9/2825 |

* cited by examiner

*Primary Examiner* — Matthew D. Troutman
(74) *Attorney, Agent, or Firm* — Jonathan F. Yates

(57) ABSTRACT

A bucket for an implement system includes a bucket body, and a first tooth mounting member and a second tooth mounting member forming first and second corners of the bucket body. The first and second tooth mounting members may be identical to one another, and are each bilaterally symmetrical. A flared shape of a longitudinal fin of each of the tooth mounting members enables abutment against a side wall of a bucket at a plurality of orientations, enabling tooth mounting members of the same design to be used at opposite corners of the bucket for positioning digging teeth at kicked-out orientations.

20 Claims, 5 Drawing Sheets

BUCKET FOR IMPLEMENT SYSTEM HAVING SYMMETRICAL TOOTH MOUNTING MEMBERS

TECHNICAL FIELD

The present disclosure relates generally to mounting digging teeth upon a bucket in an implement systems of a machine, and more particularly to a bilaterally symmetrical tooth mounting member having a longitudinal fin with a flared shape.

BACKGROUND

Ground-engaging implement systems for machines tend to be subjected to harsh operating conditions. Mechanical forces transmitted between and among components in an implement system can subject the components to tremendous stress and strain as the implement system operates to cut, dig, break, or otherwise interact with materials such as soil, gravel, concrete, and rock. In addition to mechanical forces that require robust design and construction, repeated contact with hard materials can result in significant wear upon material-engaging surfaces of the equipment.

In the case of implement systems employing a bucket, it is well known to employ replaceable teeth or tooth tips which can be swapped out when they become worn. One known design used with buckets for backhoes, excavators, and the like, employs tooth mounts that are welded to an edge of the bucket, and serve to position digging teeth for cutting into a material. The digging teeth or tooth tips can be held in place by a variety of strategies, such as pins, welding, or other forms of fastening technology.

In some systems mounting elements for the teeth are structurally integrated into the bucket itself, namely, at corners of the bucket. A single cast piece can be used to connect adjacent walls of the bucket structure, and also provide suitable geometry for tooth mounting. Additional tooth mounts and teeth are positioned between the corners along a lower edge of the bucket. It has been observed for some years that orienting bucket teeth in particular ways can enhance the digging effectiveness of the bucket in some instances, namely, orientations of the teeth that are mounted at the corners. Accordingly, in one known design integrated bucket corner tooth mounts are purpose built for their left hand or right hand position in the bucket so as to position an associated tooth at an appropriate orientation for the location.

U.S. Pat. No. 8,943,716 to Renski et al. is entitled Implement Tooth Assembly With Tip End Adapter, and proposes an adapter having a forward extending adapter nose with a keystone-shaped contour. A ground-engaging tip has a nose cavity for receiving the adapter nose, with complimentary surfaces of the adapter nose and adapter cavity increasing retention between the adapter nose and the tip when downward forces are applied.

SUMMARY OF THE INVENTION

In one aspect, a bucket for an implement system in a machine includes a bucket body having a curved body wall, a first side wall, and a second side wall, and defining a center plane positioned equidistant to the first side wall and the second side wall and vertically bisecting the curved body wall. The bucket further includes a first tooth mounting member forming a first corner of the bucket body, and a second tooth mounting member forming a second corner of the bucket body. The first tooth mounting member and the second tooth mounting member each have a forwardly projecting nose for mounting a digging tooth, a first lateral side, a second lateral side, and a longitudinally extending fin defining a plane of symmetry between the corresponding first lateral side and second lateral side. The longitudinally extending fins each have a lateral width that is increased in one of a rearward direction or a forward direction, and are positioned vertically beneath and abutting one of the first side wall and the second side wall. The first tooth mounting member and the second tooth mounting member are each angled outward relative to the center plane such that the nose of the first tooth mounting member and the nose of the second tooth mounting member are positioned for mounting a first digging tooth and a second digging tooth to extend from the first corner and the second corner, respectively, at kicked-out orientations.

In another aspect, a tooth mounting member for mounting a digging tooth upon a bucket in an implement system of a machine includes a one-piece body having a front end with a forwardly projecting nose for mounting the digging tooth, a back end, a first lateral side, a second lateral side, a lower side, and an upper side having a longitudinal fin structured for positioning beneath and abutting a side wall of the bucket. The longitudinal fin includes a forward surface, and an upper surface extending from the forward surface to the back end of the one-piece body. The longitudinal fin further defines a plane of symmetry between the first lateral side and the second lateral side, and includes a vertical height dimension and a lateral width dimension. The lateral width dimension is increased in one of a rearward direction or a forward direction, such that the upper surface of the longitudinal fin is wider toward one of the back end or the front end of the one-piece body, to accommodate a plurality of angles of contact with the side wall of the bucket.

In still another aspect, a tooth mounting member for mounting a digging tooth upon a bucket in an implement system of a machine includes a one-piece body having a front end with a forwardly projecting nose for mounting a digging tooth, a back end, a first lateral side, a second lateral side, a lower side, and an upper side having a longitudinal fin structured for positioning beneath and abutting a side wall of the bucket. The longitudinal fin defines a plane of symmetry between the first lateral side and the second lateral side, and has a lateral width dimension that is increased in one of a rearward direction or a forward direction, such that the longitudinal fin has a flared shape, to accommodate a plurality of angles of contact with the side wall of the bucket.

DETAILED DESCRIPTION

Figure 1:
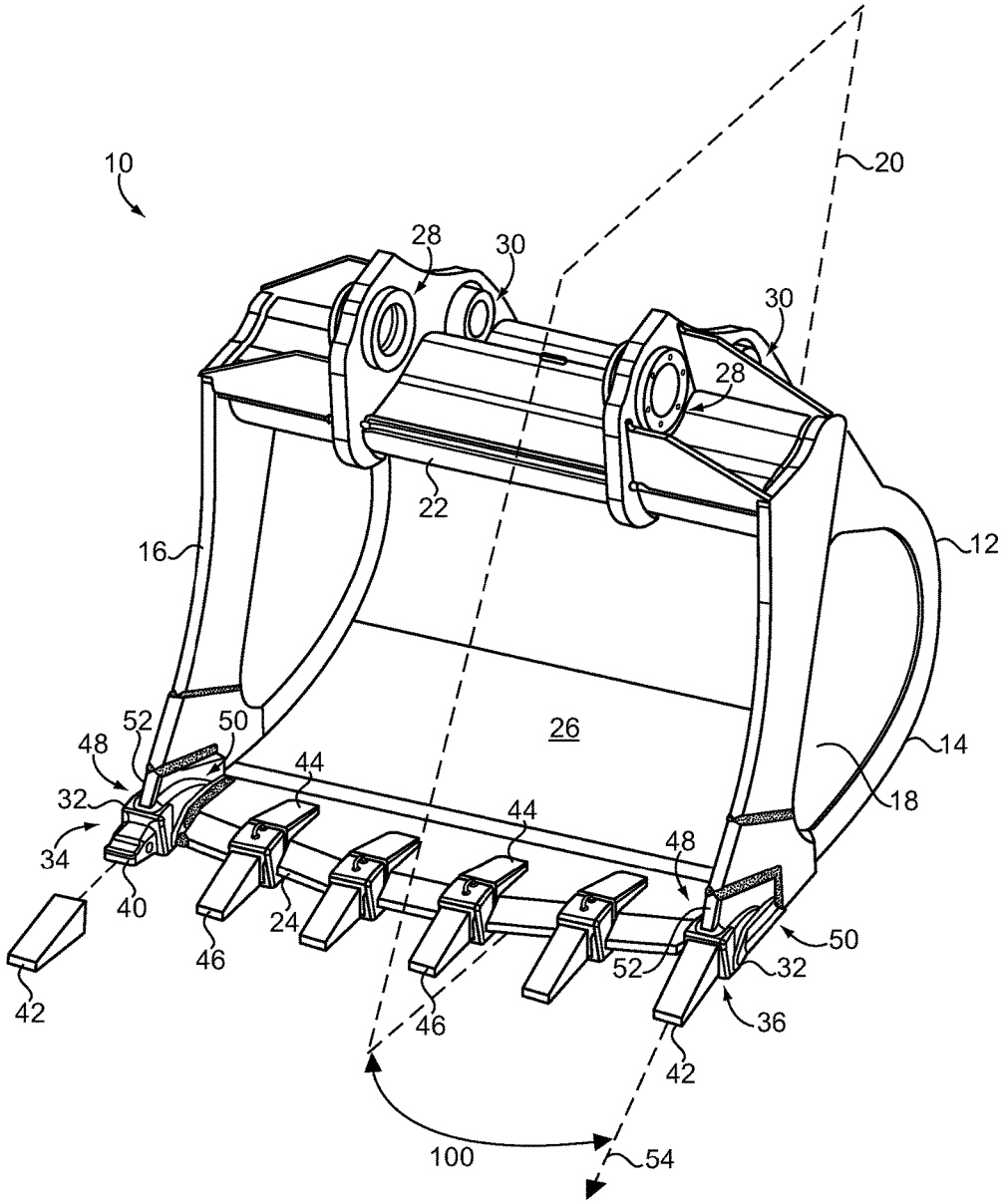
FIG. 1 is a diagrammatic view of a bucket, according to one embodiment.

Referring to FIG. 1, there is shown a bucket 10 for a hydraulically actuated implement system in a machine. Bucket 10 might be used in a machine such as a backhoe, a track excavator, a wheel excavator, a wheel loader or a track loader, a front shovel, or any of a variety of other machines known from fields such as construction, mining, forestry, agriculture, or waste handling. Bucket 10 includes a bucket body 12 constructed from a plurality of welded-together plates or the like to form an interior volume 26 for capturing and carrying a material such as soil, rock, construction debris, asphalt, waste, et cetera. Bucket body 12 may include in particular a curved body wall 14, a first side wall 16 attached to curved body wall 14 on a first side thereof, and a second side wall 18 attached to curved body wall 14 at an opposite side thereof. Bucket body 12 further defines a center plane 20 positioned equidistant to first side wall 16 and second side wall 18 and vertically bisecting curved body wall 14. In the illustrated embodiment, bucket body 12 further includes an upper edge 22 and a lower edge 24, each extending between side wall 16 and side wall 18, and each of a first set of mounting elements 28 and a second set of mounting elements 30 positioned at or near upper edge 22. Each of the sets of mounting elements 28 and 30 is structured to receive a pin or the like to couple with a lift arm, a boom, a stick, or other components of a hydraulically actuated implement system. Bucket 10 further includes a first tooth mounting member 32 forming a first corner 34 of bucket body 12, and a second tooth mounting member 32 forming a second corner 36 of bucket body 12. Each tooth mounting member 32 may be formed as a one-piece body also labeled with reference numeral 32, and could include a one-piece casting or forging.

In a practical implementation strategy each of the first and the second tooth mounting members may have substantially identical shapes and are interchangeable with one another, and therefore the same reference numeral 32 is used herein in reference to each. It should further be appreciated that a description of one or the other of the first or second tooth mounting member herein can be understood to analogously refer to the other, except where otherwise indicated or apparent from the context. As will be further apparent from the following description, tooth mounting members 32 are uniquely configured for integration into the structure of bucket 10 while providing a shape that enables a desired positioning and orientation that is suitable for tooth mounting regardless of whether the tooth mounting member 32 is installed at corner 34 or corner 36 of bucket body 12.

Each tooth mounting member 32 further includes a forwardly projecting nose 40 for mounting a digging tooth or digging tooth assembly 42, a first lateral side 48, a second lateral side 50, and a longitudinally extending fin 52 (hereinafter "longitudinal fin 52") that defines a plane of symmetry between the corresponding first lateral side 48 and second lateral side 50. Positioned between tooth mounting members 32 are a plurality of inner tooth mounting members 44 in a spaced-apart arrangement along lower edge 24. Each of inner tooth mounting members 44 may be substantially identical to one another in at least some embodiments, and are structured to support a tooth or tooth assembly 46 thereon in a manner generally analogous to tooth mounting members 32. Those skilled in the art will appreciate the diversity of tooth types and tooth shapes, mounting strategies, materials, and other properties that might be employed within the context of the present disclosure.

Tooth mounting members 32 may each be angled outward relative to center plane 20 such that nose 40 of each tooth mounting member 32 is positioned for mounting a first digging tooth 42 and a second digging tooth 42 to extend from first corner 34 and second corner 36 at kicked-out orientations. It can be seen from FIG. 1 that the plane of symmetry 54 shown associated with tooth mounting member 32 at second corner 36 forms an angle 100 with center plane 20 and tooth 42 extends outwardly from center plane 20. It has been observed that kicked-out arrangements of digging teeth positioned at bucket corners provide certain advantages with respect to clearing material for passage of bucket 10 during digging or loading.

Figure 2:
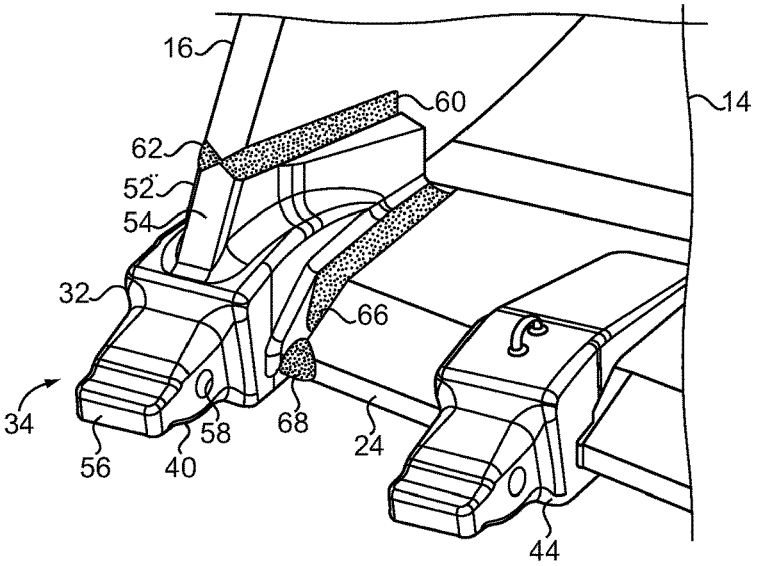
FIG. 2 is an enlarged view of a portion of the bucket of FIG. 1.
Figure 3:
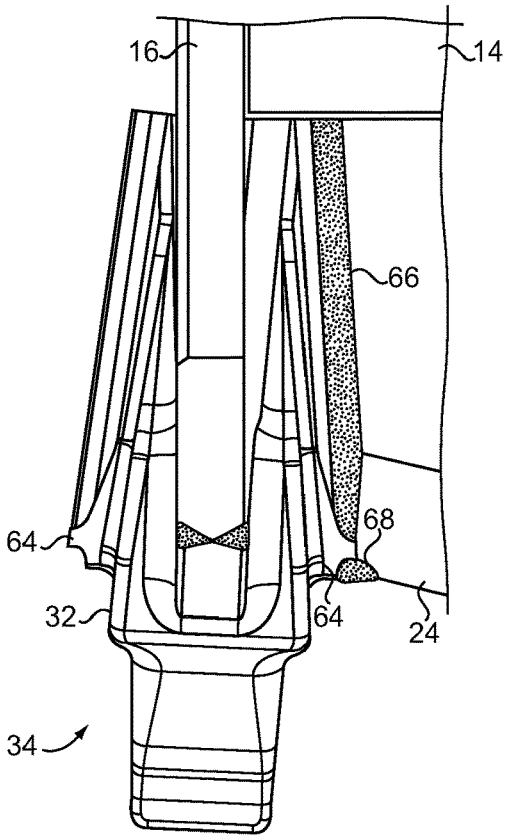
FIG. 3 is a top view of a corner of the bucket of FIGS. 1 and 2.
Figure 4:
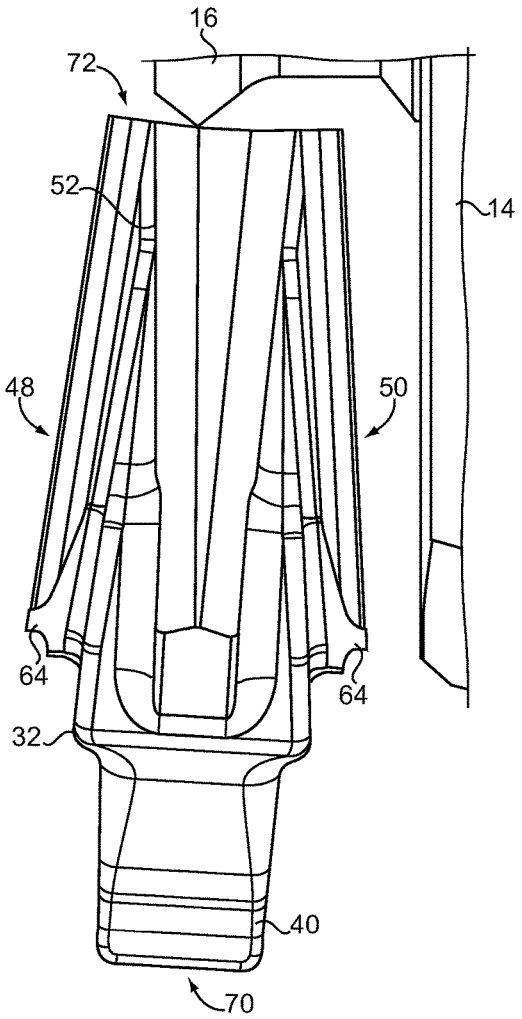
FIG. 4 is a disassembled view of components shown in the view of FIG. 3.
Figure 5:
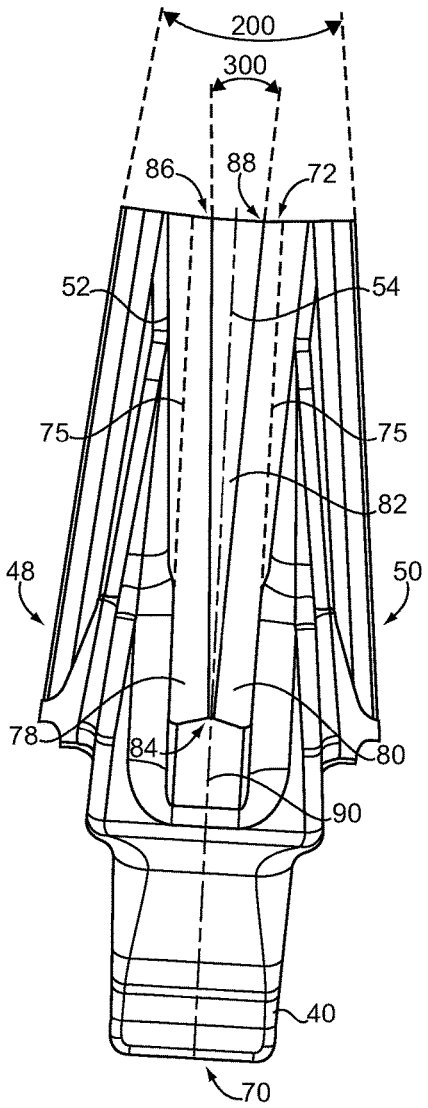
FIG. 5 is a top view of a tooth mounting member, according to one embodiment.

Referring now to FIG. 2, there are shown certain features of bucket 10 at corner 34 in greater detail. In an implementation, first side wall 16 and second side wall 18 may be oriented parallel to one another and attached to the longitudinal fin 52 of the corresponding tooth mounting member 32 by way of each of an inboard weld 60 and an outboard weld 62. Each of inboard weld 60 and outboard weld 62 may be adjacent to and positioned upon opposite sides of plane of symmetry 54 defined by longitudinal fin 52. Referring also to FIG. 3, each of first lateral side 48 and second lateral side 50 may include a longitudinally extending flange 64. One of the longitudinally extending flanges 64 of each tooth mounting member 32 may be attached to bucket body 12 by way of an upper weld 66 and a lower weld 68. Referring also to FIGS. 4 and 5, there can be seen a first beveled edge 78 and a second beveled edge 80 of longitudinal fin 52. When bucket 10 is assembled, beveled edge 80 may abut inboard weld 60, and beveled edge 78 may abut outboard weld 62. As can be seen from FIGS. 4 and 5, longitudinal fin 52 may have a shape that is relatively more narrow closer to a front end 70 of tooth mounting member 32 and a shape that is flared and relatively wider toward a back end 72 of tooth mounting member 32. The increased width of longitudinal fin 52 toward back end 72 enables side wall 16 to land squarely upon longitudinal fin 52 to form either of first corner 34 or first corner 36, as further discussed herein. In other embodiments discussed below, a lateral width of a longitudinal fin may be increased in a forward direction rather than a rearward direction such that the lateral width is relative greater toward a front end of the tooth mounting member rather than the back end as in the case of tooth mounting member 32.

First beveled edge 78 and second beveled edge 80 extend along opposite sides of longitudinal fin 52, and an upper surface 82 extends from a forward surface 90 of longitudinal fin 52 to back end 72 of tooth mounting member 32. Upper surface 82 extends between first beveled edge 78 and second beveled edge 80. The shapes and arrangement of upper surface 82, and beveled edges 78 and 80 are such that upper surface 82 is wider toward back end 72 to accommodate a plurality of angles of contact with a side wall of bucket 10. It will be recalled that side wall 16 and side wall 18 may be substantially parallel to one another. It will further be recalled that tooth mounting member 32 at first corner 34 may be substantially identical to tooth mounting member 32 used at second corner 36. By providing a flared shape of longitudinal fin 52, if mounted to form corner 34 tooth mounting member 32 can be mounted at an outward angle with side wall 16 nevertheless being provided with a sufficient area of longitudinal fin 52 to land upon, or analogously mounted at an opposite outward angle for attachment to side wall 18.

In FIG. 4 it can be seen that side wall 16 is positioned to abut longitudinal fin 52 predominantly along a left half of fin 52. Where mounting member 32 is used to form corner 36, side wall 18 could be positioned relative to tooth mounting member 32 to abut predominantly a right half of longitudinal fin 52. It can further be noted from FIG. 5 that longitudinal fin 52, and more particularly upper surface 82, forms a triangular pattern in conjunction with first beveled edge 78 and second beveled edge 80. The triangular pattern includes a first vertex 84 located adjacent to forward surface 90 of longitudinal fin 52, and a second vertex 86 and a third vertex 88 located adjacent to back end 72. In an implementation, the triangular pattern can define an isosceles triangle having a first long leg and a second long leg defined by an intersection of first beveled edge 78 with upper surface 82 and an intersection of second beveled edge 80 with upper surface 82, respectively. An angle formed by vertex 84 between the first long leg and the second long leg of the triangular may be about 10 degrees or less.

Where tooth mounting member 32 is positioned to form first corner 34, side wall 16 can abut tooth mounting member 32 along a line of contact that extends from second vertex 86 to first vertex 84 and is generally defined by the intersection of upper surface 82 and beveled edge 78. When tooth mounting member 32 is positioned to form second corner 36, side wall 18 can be positioned relative to tooth mounting member 32 to abut longitudinal fin 52 along a line of contact that extends from third vertex 88 to first vertex 84 and is generally defined by the intersection of upper surface 82 and beveled edge 80.

Figure 6:
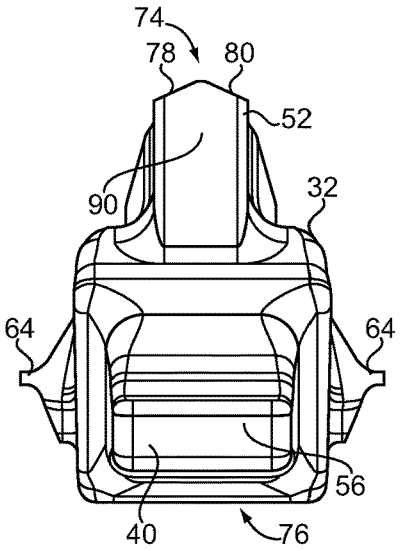
FIG. 6 is a front view of the tooth mounting member.

Referring also now to FIG. 6, there is shown a front view of tooth mounting member 32, as it might appear viewing a tip 56 of nose 40 end-on. Forward surface 90 of longitudinal fin 52 is understood to slope away in a direction into the page in FIG. 6. First beveled edge 78 and second beveled edge 80 intersect one another or very nearly intersect one another where transitioning with forward surface 90. An upper side 74 of tooth mounting member 32 of which longitudinal fin is a part, has an angled profile as shown in FIG. 6. If a sectioned view were taken through tooth mounting member 34 at a location between forward surface 90 and back end 72, the profile might include a center leg formed by upper surface 82 with adjoining side legs formed by beveled edges 78 and 80. A bottom surface 76 of tooth mounting member 32 may be substantially flat at least at the location visible in FIG. 6.

Figure 7:
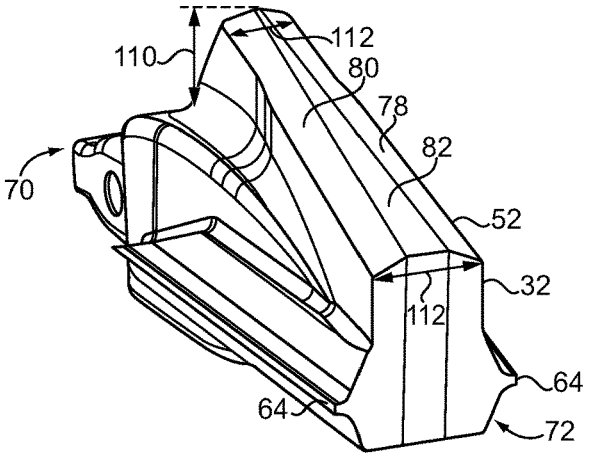
FIG. 7 is a first perspective view of the tooth mounting member.
Figure 8:
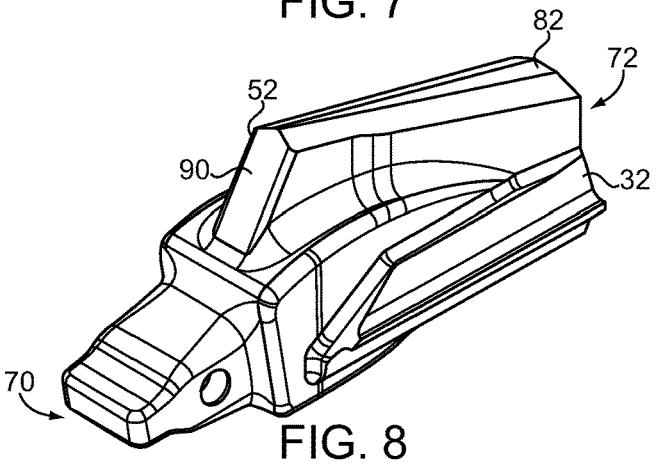
FIG. 8 is another perspective view of the tooth mounting member.

Referring also now to FIG. 7, there is shown a view of back end 72 of tooth mounting member 32 illustrating a vertical height dimension 110 of longitudinal fin 52 and a lateral width dimension 112. It can be seen that lateral width dimension 112 is relatively narrower closer to front end 70 and relatively wider closer to back end 72. The increase in lateral width dimension 112 from a location adjoining forward surface 90 to a location at back end 72 may include an increase by a factor of about one or less in some embodiments. A lateral width of upper surface 82 may be substantially equal to a lateral width of each of first beveled edge 78 and second beveled edge 80 at back end 72 of tooth mounting member 32. FIG. 8 further shows a view of tooth mounting member 32 wherein it can be seen that upper surface 82 is profiled so as to slope downwardly in a direction of back end 72.

Figure 10:
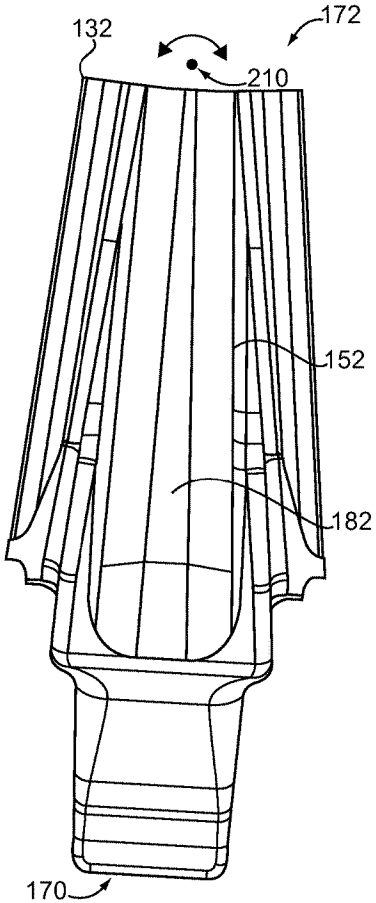
FIG. 10 is a top view of a tooth mounting member, according to another embodiment.

Referring to FIG. 10, there is shown a tooth mounting member 132 according to another embodiment. Tooth mounting member 132 has certain attributes that may be substantially identical to those of the other tooth mounting members contemplated within the context of the present disclosure, and reference is made to the foregoing description of other embodiments with regard to relative proportions, angles, and other analogous features. Descriptions of other embodiments herein can thus be understood to analogously refer to tooth mounting member 132 except where otherwise indicated or apparent from the context. It will be recalled that longitudinal fin 54 of tooth mounting member 32 is flared so as to have a width that is increased in a rearward direction. In contrast, a longitudinal fin 154 of tooth mounting member 132 has a flared shape such that a lateral width is understood to increase in a forward direction. Stated another way, the width of longitudinal fin 154 is less toward a back end 172 of tooth mounting member 132 than it is toward a front end 170. An upper surface 182 can be understood to define a triangular pattern in a manner generally analogous to that of upper surface 82 in the preceding embodiments. Upper surface 182 might slope downwardly toward front end 170, downwardly toward back end 172 generally analogous to tooth mounting member 32, be generally level, or have still another configuration.

Also shown in FIG. 10 is an axis 210 spaced rearward of back end 172. Tooth mounting member 132 can be understood as rotatable about axis 210 in opposite directions to position tooth mounting member 132 appropriately for forming a left bucket corner versus a right bucket corner. Those skilled in the art will appreciate that tooth mounting member 32 might be analogously rotated in opposite directions to position tooth mounting member 32 for forming corner 34 versus corner 36, but rather than an axis of rotation extending through or positioned adjacent to back end 72, the axis would tend to be closer to front end 70 than to back end 72. It will thus be appreciated that in at least certain implementations tooth mounting member 132 can be understood in a manner generally analogous to tooth mounting member 32, but with the direction of flare of longitudinal fin 154 being reversed as compared to the direction of flare of longitudinal fin 54.

Figure 9:
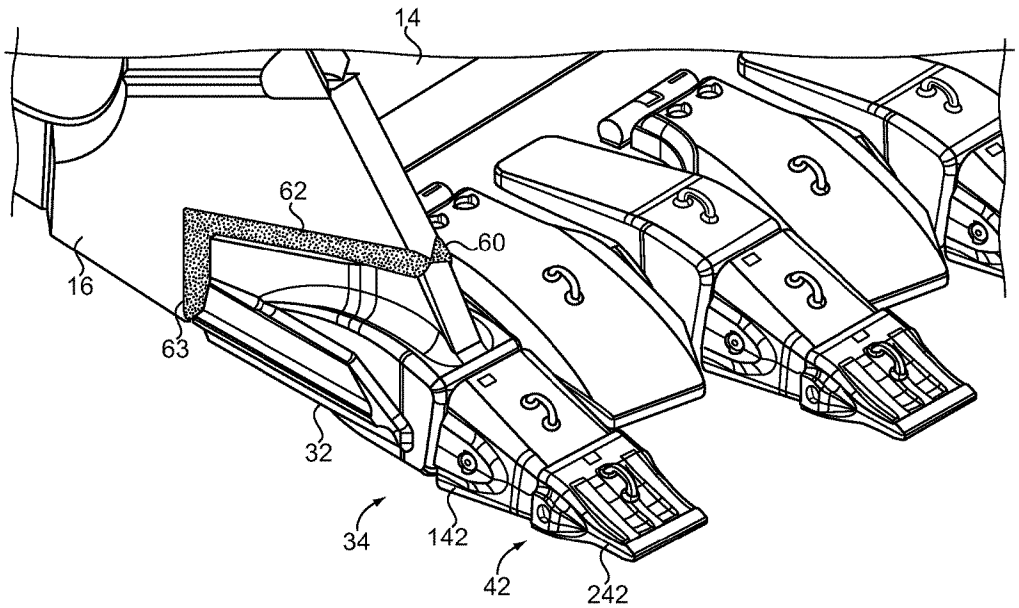
FIG. 9 is another diagrammatic view of a portion of the bucket of FIG. 1, showing additional components in greater detail.

Turning now to FIG. 9, there is shown tooth mounting member 32 positioned to form first corner 34, and also as it might appear with a tooth tip 242 and a tooth adapter 142 forming a tooth assembly 42 mounted upon tooth mounting member 32. Inboard weld 60 and outboard weld 62 can be seen extending generally rearward along the inner face between side wall 16 and tooth mounting member 32. Also shown in FIG. 9 is a vertical weld 63 that adjoins outboard weld 62. It will be understood that another vertical weld that is not visible in FIG. 9 may have a similar orientation, shape, and size to vertical weld 63.

INDUSTRIAL APPLICABILITY

It will be understood from the description herein that the same design for a one-piece body such as a casting or forging may be used to provide tooth mounting members positionable at either of two forward, lower bucket corners. By providing a flared shape of the longitudinal fin, tilting the tooth mounting member outward in a first direction relative to center plane 20 to form corner 36 or outward in an opposite direction to form corner 34 is possible without compromising structural integrity or requiring inconvenient or unduly time-intensive welds. Those skilled in the art will appreciate that only a single set of tooling, and only one part number will then be required, to provide bucket hardware for constructing kicked-out corners.

It should further be appreciated that the range of angles relative to bucket side walls that can be accommodated by tooth mounting member 32 can vary depending upon bucket design requirements or expected service applications. In one implementation, angle 100 might be from about 3 degrees to about 6 degrees. It might then be desirable to position tooth mounting member 32 from about 3 degrees to about 6 degrees away from center plane 20, therefore it being desirable to design longitudinal fin 52 to accommodate a similar angular range of potential contact with a side wall 16 or 18 of bucket 10. To accomplish this capability, an angle 300 as depicted in FIG. 5 that is formed by first vertex 84 may be about 10 degrees, or less. Angle 300 might also be from about 6 degrees to about 8 degrees. It will also be understood that lateral flange 64 upon first lateral side 48 or second lateral side 50 may have an angle relative to plane of symmetry 54 that allows lateral flange 64 to butt up relatively closely against adjacent bucket body 12, approximately as shown in FIGS. 3 and 4. In other words, it can be desirable to position lateral flange 64 generally in abutment with or close to bucket body 12 along a substantial entirety of its length. By forming the two lateral flanges 64 at angles to form a taper narrowing in a direction of back end 72, this general arrangement can be obtained regardless of whether tooth mounting member 32 is mounted to be kicked out to the right or kicked out to the left. Tooth mounting member 132 can be analogously characterized, although it will be appreciated that lines of contact between a bucket side wall and legs of a triangle defined by upper surface 182 may be the opposite of that observed with tooth mounting member 32. A size of an angle 200 formed by the taper between lateral flanges 64 may be substantially the same as a size of angle 300 in some embodiments.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A bucket for an implement system in a machine comprising:

a bucket body including a curved body wall, a first side wall, and a second side wall, and defining a center plane positioned equidistant to the first side wall and the second side wall and vertically bisecting the curved body wall;

a first tooth mounting member forming a first corner of the bucket body;

a second tooth mounting member forming a second corner of the bucket body;

the first tooth mounting member and the second tooth mounting member each having a forwardly projecting nose for mounting a digging tooth, a first lateral side, a second lateral side, and a longitudinally extending fin defining a plane of symmetry between the corresponding first lateral side and second lateral side;

the longitudinally extending fins each being positioned vertically beneath and abutting one of the first side wall or the second side wall, and having a lateral width that is increased in one of a rearward direction or a forward direction, such that each has a flared shape, and an upper surface of each of the longitudinally extending fins are wider towards one of a back end or a front end of the corresponding tooth mounting member, to accommodate a plurality of angles of contact with the corresponding one of the side walls; and the first tooth mounting member and the second tooth mounting member being angled in opposite outward directions relative to the center plane such that the nose of the first tooth mounting member and the nose of the second tooth mounting member are positioned for mounting a first digging tooth and a second digging tooth to extend from the first corner and the second corner, respectively, at kicked-out orientations such that a plane of symmetry defined by the first digging tooth and a plane of symmetry defined by the second digging tooth each form an angle, greater than zero, with the center plane that opens in a forward direction from the bucket.

2. The bucket of claim 1 wherein the first side wall and the second side wall are oriented parallel to one another and attached to the longitudinally extending fin of the first tooth mounting member and the second tooth mounting member, respectively, by way of each of an inboard weld and an outboard weld.

3. The bucket of claim 2 wherein the inboard weld attaching the first side wall to the first tooth mounting member intersects the plane of symmetry of the first tooth mounting member, and the inboard weld attaching the second side wall to the second tooth mounting member intersects the plane of symmetry of the second tooth mounting member.

4. The bucket of claim 3 wherein the longitudinally extending fin of each of the first tooth mounting member and the second tooth mounting member includes a first beveled edge and a second beveled edge abutting the inboard weld and the outboard weld, respectively.

5. The bucket of claim 2 wherein each of the first tooth mounting member and the second tooth mounting member includes a longitudinally extending lateral flange on each of the first lateral side and the second lateral side, and one of the longitudinally extending lateral flanges of each of the first tooth mounting member and the second tooth mounting member being attached to the bucket body by way of an upper weld and a lower weld.

6. The bucket of claim 1 wherein the bucket body further includes an upper edge and a lower edge each extending between the first side wall and the second side wall, and further comprising a plurality of inner tooth mounting members coupled to the bucket body and in a spaced-apart arrangement along the lower edge.

7. The bucket of claim 6 wherein the angles formed between the center plane and the planes of symmetry defined by each of the first tooth mounting member and the second tooth mounting member are each about 5 degrees or less.

8. The bucket of claim 1 wherein the first tooth mounting member and the second tooth mounting member have substantially identical shapes.

9. A tooth mounting member for mounting a digging tooth upon a bucket in an implement system of a machine comprising:

a one-piece body including a front end having a forwardly projecting nose for mounting the digging tooth, a back end, a first lateral side, a second lateral side, a lower side, and an upper side having a longitudinal fin structured for positioning beneath and abutting a side wall of the bucket;

the longitudinal fin including a forward surface, and an upper surface extending from the forward surface to the back end of the one-piece body; and the longitudinal fin further defining a plane of symmetry between the first lateral side and the second lateral side, and including a vertical height dimension and a lateral width dimension, and the lateral width dimension being increased in one of a rearward direction or a forward direction, such that the longitudinal fin has a flared shape, and the upper surface of the longitudinal fin is wider toward one of the back end or the front end of the one-piece body, to accommodate a plurality of angles of contact with the side wall of the bucket.

10. The tooth mounting member of claim 9 wherein the longitudinal fin includes a first beveled edge and a second beveled edge extending along opposite sides of the longitudinal fin, and the upper surface of the longitudinal fin extends between the first beveled edge and the second beveled edge.

11. The tooth mounting member of claim 10 wherein the lateral width dimension is increased in the rearward direction such that the upper surface of the longitudinal fin is wider toward the back end of the one-piece body, and wherein the upper surface of the longitudinal fin forms a triangular pattern having a first vertex located adjacent to the forward surface, and a second vertex and a third vertex located adjacent to the back end of the one-piece body.

12. The tooth mounting member of claim 11 wherein the increase in the lateral width dimension includes an increase by a factor of about one or less.

13. The tooth mounting member of claim 12 wherein the upper surface is profiled so as to slope downwardly in a direction of the back end of the one-piece body.

14. The tooth mounting member of claim 12 wherein a lateral width of the upper surface is substantially equal to a lateral width of each of the first beveled edge and the second beveled edge, at the back end of the one-piece body.

15. The tooth mounting member of claim 11 wherein a size of the angle formed by the first vertex is about 10 degrees or less.

16. The tooth mounting member of claim 15 wherein a size of the angle formed by the first vertex is about 6 degrees to about 8 degrees.

17. The tooth mounting member of claim 11 wherein the one-piece body further includes a first lateral flange and a second lateral flange extending outwardly from the first lateral side and the second lateral side, respectively, and forming a taper that narrows in a direction of the back end, and wherein a size of an angle formed by the taper is substantially the same as a size of the angle formed by the first vertex of the triangular pattern.

18. A tooth mounting member for mounting a digging tooth upon a bucket in a hydraulically actuated implement system of a machine comprising:

a one-piece body including a front end having a forwardly projecting nose for mounting the digging tooth, a back end, a first lateral side, a second lateral side, a lower side, and an upper side having a longitudinal fin structured for positioning beneath and abutting a side wall of the bucket;

the longitudinal fin defining a plane of symmetry between the first lateral side and the second lateral side;

the longitudinal fin further having a lateral width dimension that is increased in one of a rearward direction or a forward direction, such that the longitudinal fin has a flared shape, and the upper surface of the longitudinal fin is wider towards one of the back end or the front end of the one-piece body, to accommodate a plurality of angles of contact with the side wall of the bucket.

19. The tooth mounting member of claim 18 wherein the longitudinal fin includes a first beveled edge and a second beveled edge extending along opposite sides of the longitudinal fin, and the upper surface of the longitudinal fin extends between the first beveled edge and the second beveled edge and forms a triangular pattern.

20. The tooth mounting member of claim 19 wherein the triangular pattern defines an isosceles triangle having a first long leg and a second long leg defined by an intersection of the first beveled edge with the upper surface and an intersection of the second beveled edge with the upper surface, respectively, and wherein an angle formed by a vertex between the first long leg and the second long leg is about 10 degrees or less.

* * * * *